US006460504B1

(12) United States Patent
Phillips et al.

(10) Patent No.: US 6,460,504 B1
(45) Date of Patent: Oct. 8, 2002

(54) COMPACT LIQUID LUBRICATION CIRCUIT WITHIN AN INTERNAL COMBUSTION ENGINE

(75) Inventors: George E. Phillips, Oshkosh; Wayne M. Jaszewski, Jackson; John M. Griffiths, Fond du Lac, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 8 days.

(21) Appl. No.: 09/817,410

(22) Filed: Mar. 26, 2001

(51) Int. Cl.[7] ..... F01M 1/00
(52) U.S. Cl. ..... 123/196 R; 123/195 P
(58) Field of Search ..... 123/196 R, 90.6, 123/195 P

(56) References Cited

U.S. PATENT DOCUMENTS 4,121,558 A * 10/1978 Sakakibara et al. ..... 123/196 R
4,644,912 A * 2/1987 Umeha et al. ..... 123/90.34
4,711,203 A * 12/1987 Seidl ..... 123/90.34
4,896,634 A 1/1990 Kronich ..... 123/90.34
5,027,762 A 7/1991 Tokuyama et al. ..... 123/90.34
5,090,375 A 2/1992 Hudson ..... 123/196
5,524,581 A 6/1996 Rush et al. ..... 123/90.34
5,887,557 A * 3/1999 Battlogg ..... 123/90.17
5,937,812 A * 8/1999 Reedy et al. ..... 123/90.34
5,996,561 A 12/1999 Watanabe ..... 123/572
6,170,448 B1 1/2001 Asakura ..... 123/90.18

* cited by examiner

*Primary Examiner*—Noah P. Kamen
*Assistant Examiner*—Jason Benton
(74) *Attorney, Agent, or Firm*—William D. Lanyi

(57) ABSTRACT

An oil lubrication circuit is provided for an internal combustion engine in which first and second paths are located within a central bore of a camshaft. Liquid lubricant is directed from a gerotor pump to an oil filter and back toward numerous lubrication points of a crankshaft by utilizing the first and second paths which flow in opposite directions and which are both concentric with a central axis of rotation of the camshaft.

15 Claims, 4 Drawing Sheets

COMPACT LIQUID LUBRICATION CIRCUIT WITHIN AN INTERNAL COMBUSTION ENGINE

BACKGROUND OF THE INVENTION

1. Field of the Invention

The present invention is generally related to a lubrication circuit for an engine and, more particularly, to a lubrication system that efficiently uses an internal structure of a rotating shaft as a dual fluid path for lubricating oil.

2. Description of the Prior Art

Those skilled in the art of internal combustion engines know that lubrication of certain regions of the engine, where one surface slides on another surface, is crucial to maintaining the proper operation of the engine. Many types of lubrication circuits are well known to those skilled in the art.

U.S. Pat. No. 4,896,634, which issued to Kronich on Jan. 30, 1990, describes a phase timed camshaft spray lubrication system. The lubrication system, which is for an internal combustion engine, causes lubricating oil to flow through a central bore of a camshaft, and the camshaft sprays oil into a journal bearing. The crankshaft and camshaft are configured so that they are in phase, whenever the camshaft is closest to the crankshaft during a rotation, the camshaft sprays oil into the internal bearing. Since the crankshaft has twice the rotational velocity of the camshaft, two spray holes are provided in the camshaft so that a spray hole supplies oil on each cycle of the crankshaft rotation.

U.S. Pat. No. 5,524,581, which issued to Rush et al on Jun. 11, 1996 describes an outboard motor with an improved engine lubrication system. An internal combustion engine comprises a cylinder block which defines a cylinder, a crankshaft bearing supported at least in part by the cylinder block, a crankshaft which is rotatably supported by the crankshaft bearing, a piston slidably housed in the cylinder, a connecting rod having one end connected to the piston and having an opposite end connected to the piston and having an opposite end connected to the crankshaft, a cylinder head mounted on the cylinder block, a camshaft at least partially supported by the cylinder head for rotation relative thereto, and an oil pump having an inlet. It further comprises a first oil conduit communicating between the oil pump outlet and the crankshaft bearing, an oil filter communicating with the first oil conduit for filtering oil only in the first conduit, and a second oil conduit communicating between the oil pump outlet and the camshaft, oil in the second oil conduit being unfiltered between the pump outlet and the camshaft.

U.S. Pat. No. 5,996,561, which issued to Watanabe on Dec. 7, 1999, describes a vapor separator for an outboard motor. The outboard motor has a cowling and a water propulsion device. An internal combustion engine is positioned in the cowling and arranged to propel the water propulsion device. A crankshaft of the engine is supported for rotation with respect to the engine block and is located in a first chamber. A camshaft is supported for rotation with respect to the engine block and is located in a second chamber. The engine further includes a lubrication system for the lubrication of the crankshaft and the camshaft. A lubrication collection area is located on the bottom side of the engine for the gravitational collection of engine lubrication fluid from the first chamber and the second chamber.

U.S. Pat. No. 5,027,762, which issued to Tokuyama et al on Jul. 2, 1991, describes a lubrication system for a multi-cylinder engine. The system has a valve drive mechanism equipped with a row of hydraulic valve lash adjusters installed in a cylinder head of an engine block of an engine and a camshaft with journals which is disposed over the cylinder head and is attached, at one end thereof, with a camshaft pulley coupled to a crankshaft pulley by a belt. The lubrication system includes a main oil gallery extending lengthwise in the engine body, a lash adjuster oil gallery formed in the cylinder and extending along the row of hydraulic valve lash adjusters and a camshaft oil gallery formed in the cylinder head and extending parallel to the lash adjuster oil gallery.

U.S. Pat. No. 6,170,448, which issued to Asakura on Jan. 9, 2001, describes a variable valve timing apparatus. It includes a phase adjuster for adjusting the rotational phase of the camshaft relative to a crankshaft and a lift adjuster for axially moving the camshaft. The phase adjuster has a timing pulley rotated synchronously with the crankshaft and a housing fixed to the timing pulley. A vein rotor rotating synchronously with the camshaft is arranged in the housing to define a first pressure chamber and a second pressure chamber in the housing. Hydraulic fluid is delivered to the first and second pressure chambers through oil conduits to rotate the vein rotor with respect to the housing and change the rotational phase of the camshaft relative to the crankshaft. The oil conduits extend through the timing pulley. This prevents the axial movement of the camshaft from affecting the hydraulic pressure of the pressure chambers. Accordingly, the valve timing is varied accurately.

U.S. Pat. No. 5,090,375, which issued to Hudson on Feb. 25, 1992, describes a valve gear oiling system for an overhead camshaft engine. A single cylinder, overhead cam, internal combustion engine lubrication system where lubricating oil is pumped from a crankcase oil sump through oil passages to the upper bearings of the crankshaft and camshaft is disclosed. The oil leaks from the bearings, adheres and flows down the shafts which is flung by rotation thereby lubricating the cam lobes and valve tappets. Oil, accumulating in the cam chamber sump, lubricates the lower camshaft bearing before being pumped through the closed looped circulatory system.

The United States patents described above are hereby expressly incorporated by reference in the description of the present invention.

Oil lubrication systems for engines typically require numerous and complex series of cast and drilled holes to provide lubrication oil passages to critical engine components, such as the crankshaft bearings of the engine. These cast and drilled holes are an expensive element of the engine's manufacturing costs. Many of the oil passage holes must then be plugged where they break through an outside surface of the engine. Eliminating as many of these holes and passages as possible will reduce the overall cost and weight of the engine. Furthermore, the required plugs at the end of passages, where they break through an outside surface of the engine, also create an additional possibility of oil leakage. It would therefore be significantly beneficial if an oil lubrication circuit could be provided that minimizes the requirement for drilled and cast holes and passages within the cylinder block of the engine.

SUMMARY OF THE INVENTION

An engine made in accordance with the preferred embodiment of the present invention comprises a first shaft supported for rotation about a first axis within the engine. In addition, it comprises a conduit formed within the first shaft and extending along the first axis for at least a portion of the length of the first shaft. The liquid conduit has an inlet for conducting a liquid into the conduit and an outlet for conducting the liquid out of the conduit. The conduit comprises a first path and a second path, wherein the first and second paths extends in opposite directions generally parallel to the first axis of the first shaft.

The engine made in accordance with the present invention can further comprise a second shaft supported for rotation about a second axis within the engine. The first shaft is a camshaft and the second shaft is a crankshaft. A liquid pump is disposed within the body of the engine and in fluid communication between the first and second paths. The first and second paths can be concentric with each other and with the first axis. A tube is disposed within a central bore of the first shaft with the tube defining the first path within a central opening of the tube and the second path being defined between an outer cylindrical surface of the tube and an inner cylindrical surface of the central bore of the first shaft. The engine can be a powerhead of an outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
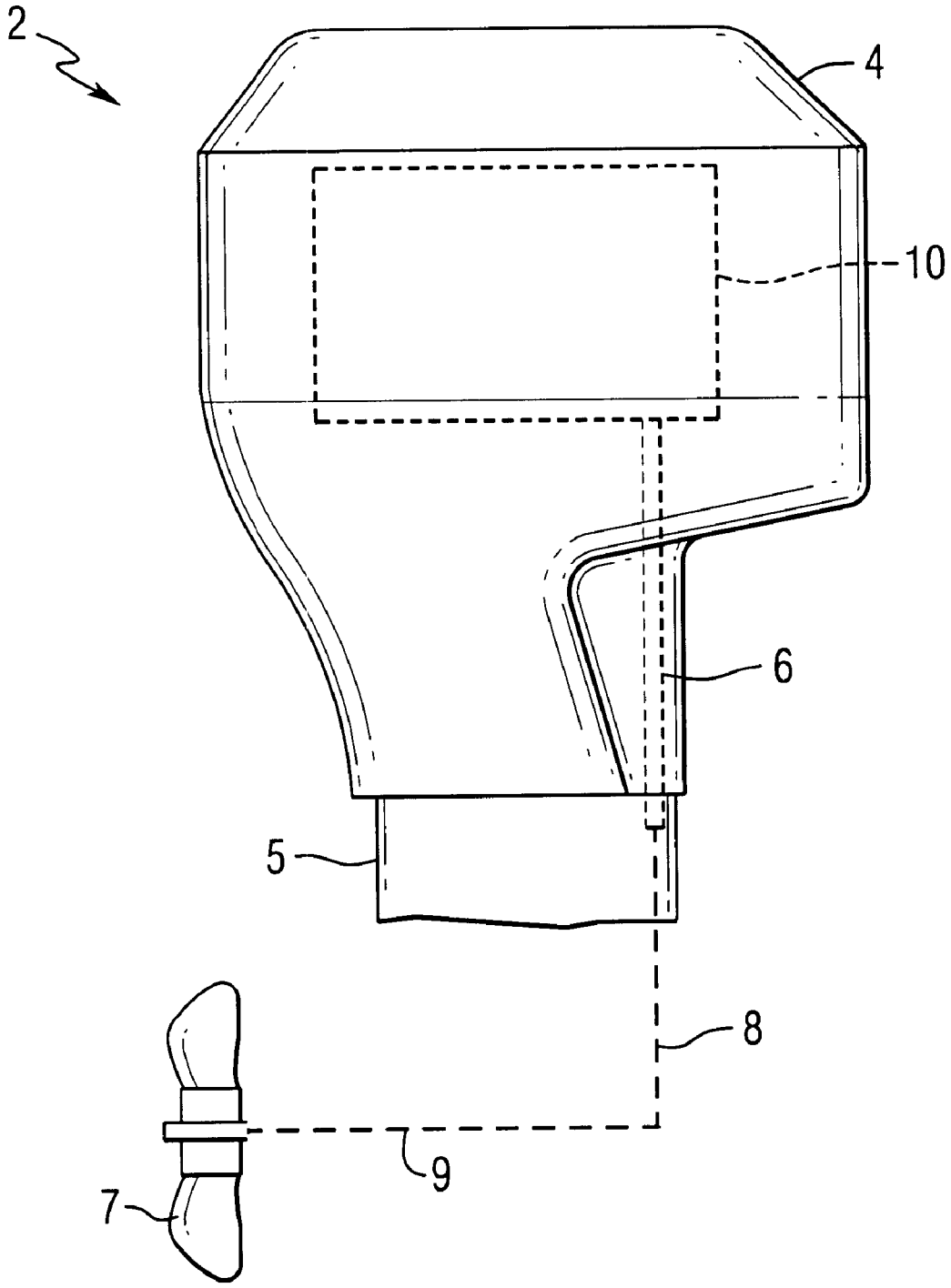
FIG. 1 PRIOR ART
FIG. 1 is a schematic representation of a outboard motor known in the prior art.

Throughout the description of the preferred embodiment of the present invention, like components will be identified by like reference numerals.

FIG. 1 illustrates a side view of an outboard motor 2 which comprises a cowl 4 that defines a cavity in which an engine 10 is disposed. The engine drives a crankshaft which, in turn, drives a driveshaft 6 that is arranged in torque transmitting relation with a propeller 7. This torque transmitting relation is provided by a series of rotatable shafts and gears that are well known to those skilled in the art and are schematically represented by dashed lines 8 and 9 in FIG. 1. The driveshaft housing 5 is only partially shown in FIG. 1.

FIG. 1 is intended to show the basic relationship and location of the engine 10 in relation to the structure of an outboard motor 2.

Figure 2:
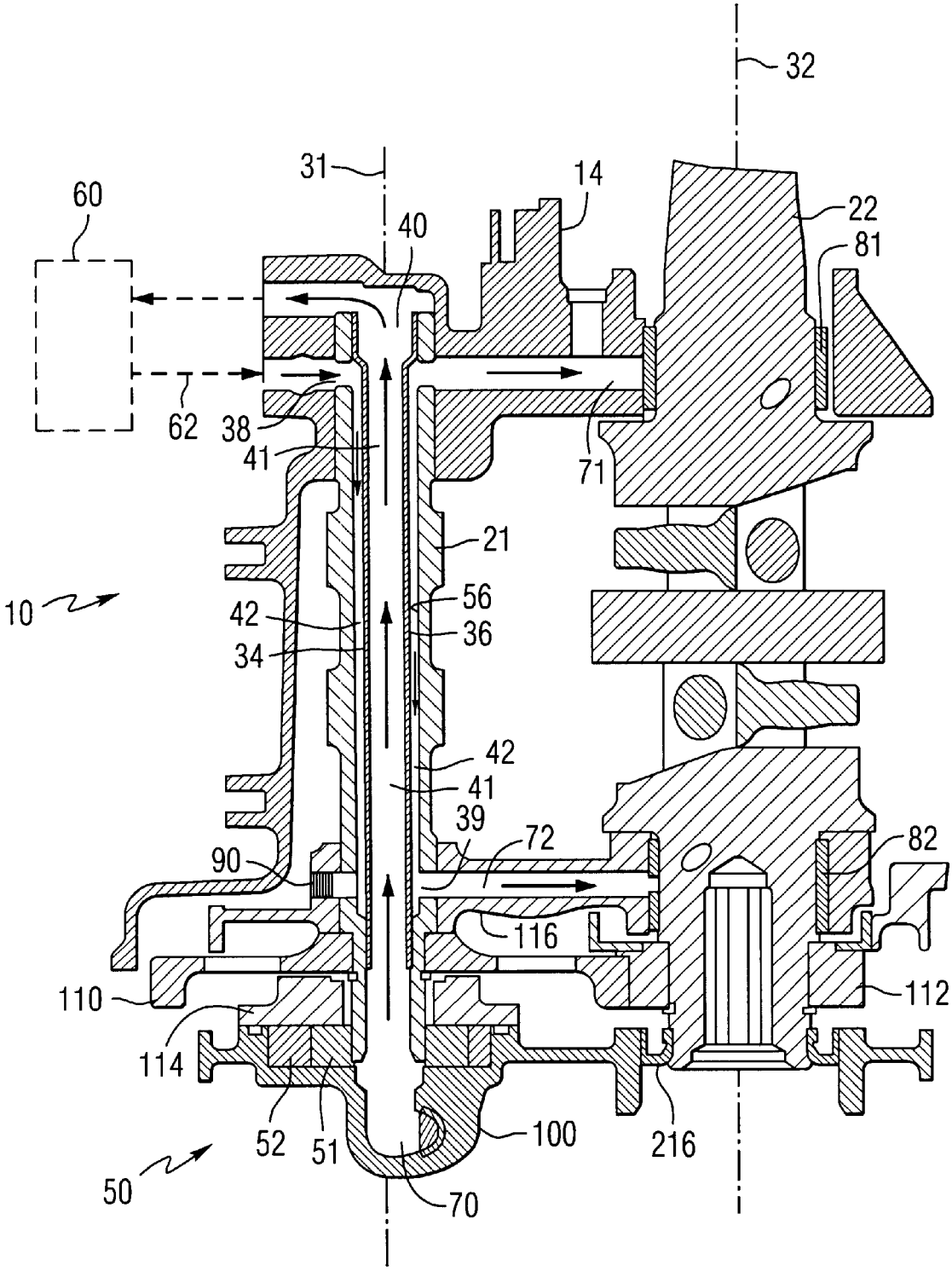
FIG. 2 is a side section view of an internal combustion engine incorporating the present invention.

FIG. 2 is a section view of an internal combustion engine 10. A cylinder block 14 is shaped to support a first shaft 21 and a second shaft 22 for rotation about the first and second axis, respectively. The first shaft 21 is a camshaft that is rotatably supported for rotation about a first axis 31. The second shaft 22 is rotatably supported by the cylinder block 14 for rotation about a second axis of rotation 32.

With continued reference to FIG. 2, it can be seen that the first shaft is provided with a conduit 31 that is formed within the first shaft. As will be described in greater detail below, the conduit comprises a tube 36 disposed within an internal cavity of the first shaft 21.

The conduit 34 extends along the first axis 31 for at least a portion of the length of the first shaft. In the embodiment shown in FIG. 2, the conduit 34 extends along the full length of the first shaft 21, but this is not a requirement in all embodiments of the present invention. The liquid conduit 34 has an inlet 38 and an outlet 40. As will be described in greater detail, the conduit 34 also has other inlets and outlets. The conduit 34 comprises a first path 41 and a second path 42. The first and second paths, 41 and 42, extend in opposite directions and are generally parallel to each other and to the first axis 31. It should be understood that the nature of the first and second paths extending in opposite directions is defined by the intended direction of liquid flow through those paths. It should also be understood that these directions can be reversed in alternative embodiments of the present invention.

The second shaft 22 is a crankshaft of the engine 10 and is supported for rotation about a central axis 32. In a preferred embodiment of the present invention, the first and second axes, 31 and 32, are generally parallel to each other and disposed in a vertical arrangement when the engine 10 is used as a powerhead for an outboard motor.

With continued reference to FIG. 2, an oil pump 50 comprises two rotating lobed members, 51 and 52, which cooperate to pressurize the liquid lubricant and because it to flow upward through the first path 41. The preferred embodiment of the present invention uses a gerotor pump which operates according to concepts that are well known to those skilled in the art. In the embodiment illustrated in FIG. 2, the first path 41 and the second path 42 are generally concentric with each other and with the first axis 31. The second path 42 is annular in shape and exists within the generally cylindrical cavity defined by the outer surface of the tube 36 and the inner cylindrical surface 56 of the central bore of the first shaft 21. The first path 41 is defined by the central opening of the tube 36.

With continued reference to FIG. 2, the arrows within the conduit 34 illustrate the path of a liquid lubricant as it flows from the gerotor pump 50 upward along the first path 41 within the central opening of the tube 36 and returning downward along the second path 42 toward the gerotor pump 50. The dashed line box 60 represents an oil filter that is disposed between the first and second paths, 41 and 42, to remove certain impurities and debris from the liquid lubricant. As the oil returns from the oil filter 60, as represented by dashed line arrow 62, it enters the inlet 38 and passes downward along the second path 42 toward the pump 50 and toward the upper and lower crankshaft oil passages, 71 and 72. When the fluid reaches the region of the gerotor pump, after returning from various lubricated regions of the engine, it is pressurized and this pressurized lubricant flows upward from the cavity 70 along the first path 41 to return back to the filter 60. Between the first path 41 and the second path 42, the oil is directed to flow toward certain regions of the engine that require lubrication. For example, conduits 71 and 72 represent upper and lower crankshaft oil passages connected in fluid communication with the second path 42 which direct lubricant to bearings that support the crankshaft 22. These bearings are identified by reference numerals 81 and 82 which, in a preferred embodiment of the present invention, are metallic cylinders that are pressed into position within the cylinder block 14 and which are lubricated by oil flowing from the second path 42. As the oil travels along its lubricated paths within the cylinder block 14, it eventually flows back toward the gerotor pump 50, primarily under the influence of gravity. The gerotor pump 50 then pressurizes the oil again and causes it to flow upward along the first path 41.

By using the conduit 34 formed within the first shaft 21, the present invention efficiently directs a liquid lubricant along paths that do not require that additional passages be cast into the cylinder block 14 or drilled into it. Although certain conduits, such as those identified by reference numerals 71 and 72, may require drilling and plugging, such as by plug 90, the use of the conduit 34 significantly reduces the number of these types of required oil passages.

With continued reference to FIG. 2, a bottom cover 100 defines a bottom portion of the cylinder block 14 and also provides the lower housing of the gerotor pump 50. A gear 110 is attached to the first shaft 21 to provide a motive force that rotates the camshaft in response to rotation of the crankshaft 22 and its associated gear 112. Reference numeral 114 identifies a cover of the gerotor pump 50 and reference numeral 116 identifies a separate casting that is attached to the cylinder block 14 as a lower support for both the first and second shafts, 21 and 22, about their respective axis, 31 and 32, respectively.

Figure 3:
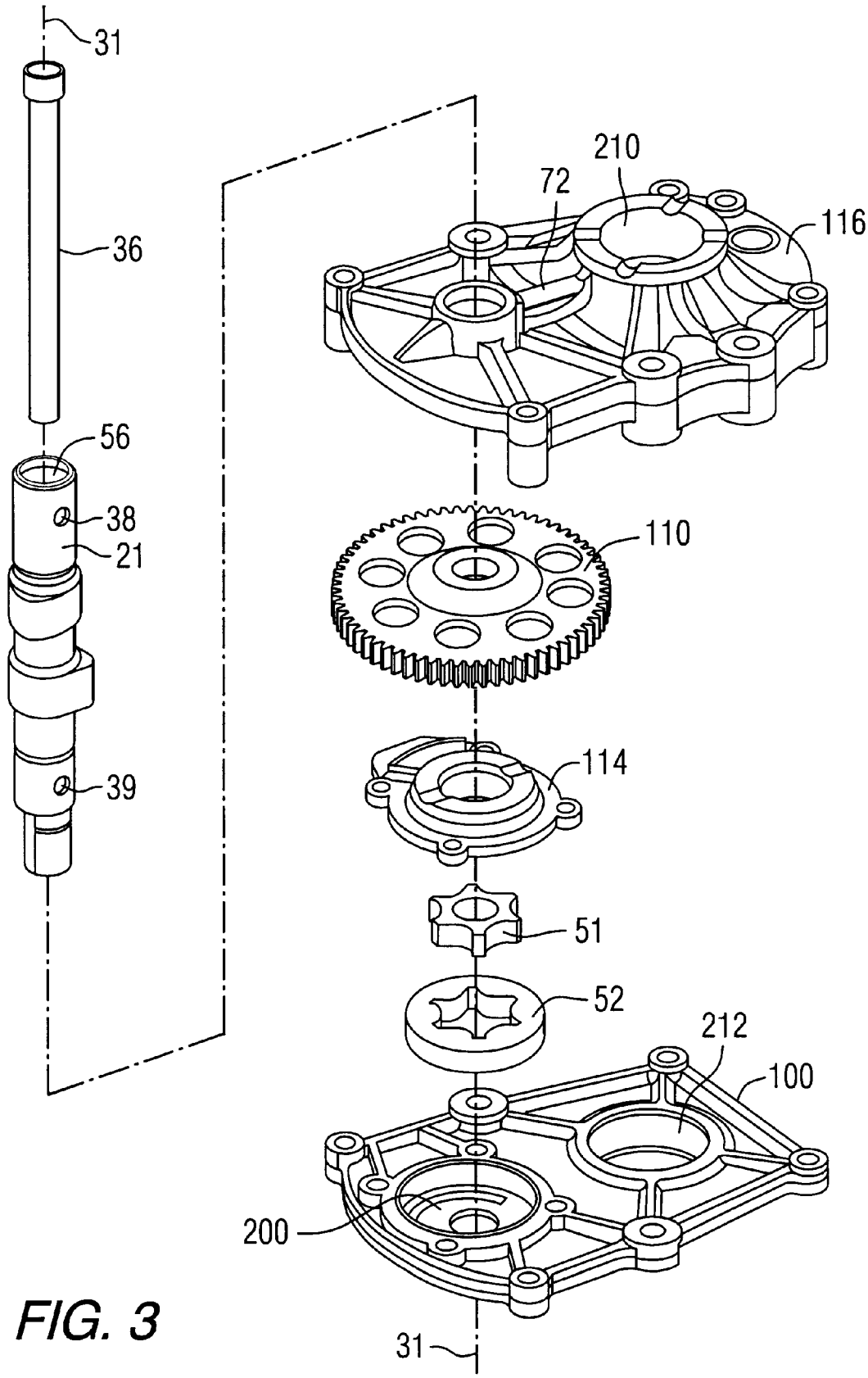
FIG. 3 is an exploded isometric view of the present invention.

FIG. 3 is an exploded isometric view of some of the components of the present invention. The lower cover 100 is provided with a first cavity 200 that is shaped to receive the inner and outer, 51 and 52, lobed members of the gerotor pump within it. The cover 114 of the gerotor pump encloses the cavity 200, with s the lobed members of the gerotor pump within it in order to define a pressure cavity. Along with the inner lobed member 51 and the outer lobed member 52 of the gerotor pump, gear 110 is driven by the first shaft 21 which, as illustrated in FIG. 3, is a camshaft of the internal combustion engine 10. The central bore 56 of the camshaft is shaped to define the oil conduit 34 described above in conjunction with FIG. 1. Tube 36 is shaped to be received by the central bore 56 in a press fit relationship. As described above, the combination of the tube 36 and the central bore 56 of the first shaft 21 define the first and second paths, 41 and 42.

With continued reference to FIG. 3, the component identified by reference numeral 116 provides a bore 210 that is shaped to receive the bearing sleeve 82 described above, and also provides a metallic portion through which conduit 72 is drilled to provide the lubricant flow from the second path 42 to bearing 82 which is disposed within opening 210. In the lower cover 100, opening 212 is provided with a seal 216 which is illustrated in FIG. 2.

The two radial flow paths, 38 and 39, of the first shaft 21 are formed by drilling diametric holes through the camshaft. After tube 36 is inserted into the central bore 56 of the first shaft 21, these holes, 38 and 39, define the outlet through which the oil can pass from the second path 42 to the upper main bearing 81 and the lower main bearing 82. These outlets, 38 and 39, are in fluid communication with the upper crankshaft oil passage 71 and the lower crankshaft oil passage 72. Hole 38 also serves as an inlet into flow path 42.

With reference to FIGS. 2 and 3, it can be seen that the oil flowing upward along the first path 41 within the central opening of the tube 36 is flowing away from the regions of the engine that require lubrication. As such, this oil flowing along the first path 41 may contain debris. It is therefore directed toward and through the filter 60 to remove the debris. The clean oil is returned, as represented by arrow 62, to inlet 38 of the conduit 34 to flow along the second path 42. It should be noted that hole 38, which defines two holes through the wall of the first shaft 21, serves to allow oil from the oil filter 60 to flow into the second path 42 and also allows oil from the second path 42 to flow to the upper crankshaft oil passage 71 and toward the upper main bearing 81.

Figure 4:
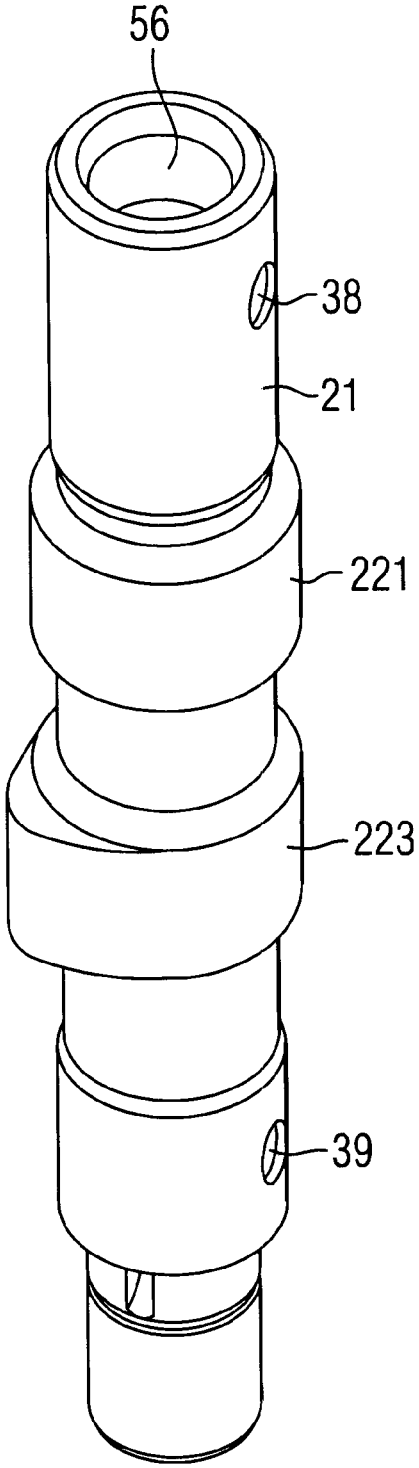
FIG. 4 is an isometric view of a camshaft made in accordance with the present invention.

FIG. 4 is an isometric view of the first shaft 21 which is a camshaft with a plurality of cam surfaces, 221 and 223. The upper hole 38 and the lower hole 39 are drilled completely through the first shaft 21. The bottom portion of the first shaft 21 is shaped to be received in press fit relation into the inner lobed component 51. This press fit allows the inner lobed component 51 of the gerotor pump 50 to be firmly attached to the first shaft 21 for rotation therewith. Therefore, as gear 110, illustrated in FIGS. 2 and 3, is rotated by its meshing association with gear 112, the first shaft 21 is rotated and the inner lobed member 51 of the gerotor pump 50 rotates with the first shaft because of the press fit.

Figure 5:
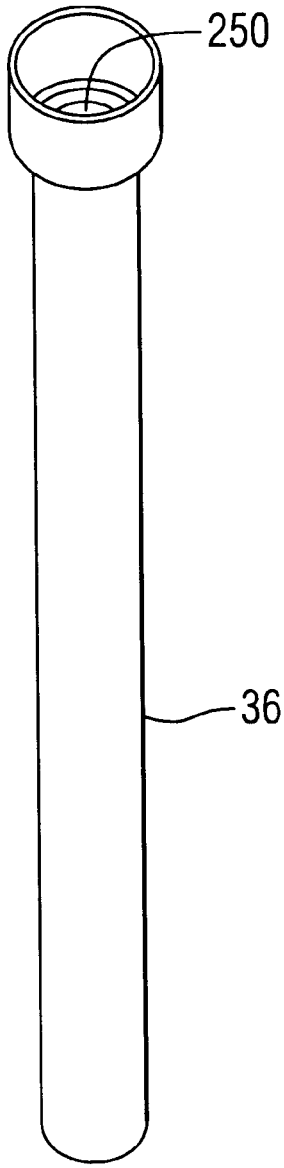
FIG. 5 is an isometric view of a tube used in a preferred embodiment of the present invention.

FIG. 5 shows the tube 36 which has the central opening 250 and is shaped to be received within the central bore 56 of the first shaft 21 in press fit relation. With reference to FIGS. 2, 4, and 5, it can be seen how the combination of the tube 36 and the first shaft 21 define the first and second paths, 41 and 42, of the conduit 34.

With reference to FIGS. 2–5, it can be appreciated that the association of the tube 36 within the central bore 56 of the first shaft 21 provides a conduit 34 which, in turn, provides a very efficient packaging of the first and second paths, 41 and 42, which direct oil from the gerotor pump 50 to the oil filter 60 and back into the conduit 34 for conduction to various lubrication points of the engine.

Although the present invention has been described in particular detail to illustrate a preferred embodiment and has been illustrated to show that embodiment in numerous views, alternative embodiments of the present invention are also within its scope.

We claim:

1. An engine, comprising:

a first shaft supported for rotation about a first axis within said engine; and a conduit formed within said first shaft and extending along said first axis for at least a portion of the length of said first shaft, said conduit having an inlet for conducting a liquid into said conduit and an outlet for conducting said liquid out of said conduit, said conduit comprising a first path and a second path, said first and second paths extending in opposite directions generally parallel to said first axis.

2. The engine of claim 1, further comprising:

a second shaft supported for rotation about a second axis within said engine.

3. The engine of claim 2, wherein:

said first shaft is a camshaft and said second shaft is a crankshaft.

4. The engine of claim 1, further comprising:

a liquid pump disposed within said engine and in fluid communication between said first and second paths.

5. The engine of claim 1, wherein:

said first and second paths are concentric with each other about said first axis.

6. The engine of claim 1, further comprising:

a tube disposed within a central bore of said first shaft, said tube defining said first path within a central opening of said tube, said second path being disposed between an outer cylindrical surface of said tube and an inner cylindrical surface of said central bore of said first shaft.

7. The engine of claim 1, wherein:

said engine is a powerhead of an outboard motor.

8. An engine, comprising:

a camshaft supported for rotation about a first axis within said engine;

a crankshaft supported for rotation about a second axis within said engine;

a conduit formed within said camshaft and extending along said first axis for at least a portion of the length of said camshaft, said conduit having an inlet for conducting a liquid into said conduit and an outlet for conducting said liquid out of said conduit, said conduit being a liquid lubricant conduit comprising a first path and a second path; and a tube disposed within a central bore of said camshaft, said tube defining said first path within a central opening of said tube, said second path being disposed between an outer cylindrical surface of said tube and an inner cylindrical surface of said central bore of said camshaft.

9. The engine of claim 8, wherein:

said first and second paths extend in opposite directions generally parallel to said second axis.

10. The engine of claim 9, further comprising:

an pump disposed within said engine and in fluid communication between said first and second paths.

11. The engine of claim 10, wherein:

said first and second paths are concentric with each other about said second axis.

12. The engine of claim 11, wherein:

said engine is a powerhead of an outboard motor.

13. An engine for an outboard motor, comprising:

a camshaft supported for rotation about a first axis within said engine;

a crankshaft supported for rotation about a second axis within said engine; and an oil conduit formed within said camshaft and extending along said first axis for at least a portion of the length of said camshaft, said oil conduit having an inlet for conducting a liquid into said oil conduit and an outlet for conducting said liquid out of said oil conduit, said oil conduit comprising a first path and a second path extending in opposite directions generally parallel to said second axis.

14. The engine of claim 13, further comprising:

an oil pump disposed within said engine and in fluid communication between said first and second paths, said first and second paths being concentric with each other about said second axis.

15. The engine of claim 14, further comprising:

a tube disposed within a central bore of said camshaft, said tube defining said first path within a central opening of said tube, said second path being disposed between an outer cylindrical surface of said tube and an inner cylindrical surface of said central bore of said camshaft.

* * * * *